US010808493B2

(12) United States Patent
Du et al.

(10) Patent No.: US 10,808,493 B2
(45) Date of Patent: Oct. 20, 2020

(54) PACKER SYSTEM HAVING LOCKABLE MECHANISM

(71) Applicant: Schlumberger Technology Corporation, Sugar Land, TX (US)

(72) Inventors: Quangen Du, Fresno, TX (US); Brian John Bethscheider, Alvin, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 722 days.

(21) Appl. No.: 15/297,746

(22) Filed: Oct. 19, 2016

(65) Prior Publication Data

US 2018/0106127 A1 Apr. 19, 2018

(51) Int. Cl.
*E21B 23/06* (2006.01)
*E21B 33/129* (2006.01)
*E21B 33/128* (2006.01)

(52) U.S. Cl.
CPC ..... *E21B 33/1293* (2013.01); *E21B 23/06* (2013.01); *E21B 33/1285* (2013.01)

(58) Field of Classification Search
CPC .. E21B 23/06; E21B 33/1291; E21B 33/1293; E21B 33/1295
See application file for complete search history.

(56) References Cited

U.S. PATENT DOCUMENTS

| | | | | |
|---|---|---|---|---|
| 5,046,557 | A * | 9/1991 | Manderscheid | E21B 33/1295 166/120 |
| 5,103,901 | A * | 4/1992 | Greenlee | E21B 33/1295 166/120 |
| 5,320,183 | A | 6/1994 | Muller et al. | |
| 6,050,342 | A | 4/2000 | Ramsey | |
| 6,779,600 | B2 | 8/2004 | King et al. | |
| 7,967,077 | B2 * | 6/2011 | Ezell | E21B 33/1295 166/120 |
| 8,936,101 | B2 * | 1/2015 | McGlothen | E21B 33/1285 166/387 |
| 8,967,280 | B2 | 3/2015 | Doane et al. | |
| 9,447,649 | B2 * | 9/2016 | Doane | E21B 33/1272 |
| 2016/0356117 | A1 * | 12/2016 | Tuckness | E21B 23/06 |
| 2018/0106127 | A1 * | 4/2018 | Du | E21B 23/06 |
| 2019/0040699 | A1 * | 2/2019 | Perez | E21B 23/06 |

FOREIGN PATENT DOCUMENTS

WO WO-2017204785 A1 * 11/2017 ..... E21B 23/06

* cited by examiner

*Primary Examiner* — Daniel P Stephenson
(74) *Attorney, Agent, or Firm* — Cameron R. Sneddon

(57) ABSTRACT

A technique facilitates temporary locking of a mechanical packer to prevent inadvertent actuation of the mechanical packer. The mechanical packer may be set via manipulation of a setting mandrel which works in cooperation with a releasable locking mechanism. The releasable locking mechanism may be initially locked against the setting mandrel and held in place via a piston, e.g. an annular piston, received in a piston chamber, e.g. an annular chamber surrounding the setting mandrel. The piston may be selectively shifted via pressure applied in the piston chamber so as to release the releasable locking mechanism, thus enabling actuation of the mechanical packer.

20 Claims, 5 Drawing Sheets

PACKER SYSTEM HAVING LOCKABLE MECHANISM

BACKGROUND

In a variety of well applications, a well string comprises a packer or a plurality of packers to enable isolation of sections of a wellbore when the well string is deployed downhole into the wellbore. A packer generally is deployed downhole in a radially contracted state and then actuated to a radially expanded or set configuration once positioned at the desired location in the wellbore. Setting of the packer causes the packer to grip and seal against the surrounding casing or other wellbore wall. If the packer is set prematurely, difficulties arise in conveying the packer to the desired wellbore location and this can have detrimental effects with respect to deployment and operation of the well string.

SUMMARY

In general, a system and methodology facilitate temporary locking of a mechanical packer to prevent inadvertent actuation of the mechanical packer, e.g. to prevent setting of the packer prior to reaching a desired borehole location. The mechanical packer may be set via manipulation of a setting mandrel which works in cooperation with a releasable locking mechanism, e.g. a collet. The releasable locking mechanism may be initially locked against the setting mandrel and held in place via a piston, e.g. an annular piston, received in a piston chamber, e.g. an annular chamber surrounding the setting mandrel. The piston may be selectively shifted via pressure applied in the piston chamber so as to release the releasable locking mechanism, thus enabling actuation of the mechanical packer.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate temporary locking of a mechanical packer. The ability to temporarily lock the mechanical packer limits the potential for inadvertent actuation of the mechanical packer. For example, the mechanical packer may be temporarily locked during running in hole to prevent premature actuation of the mechanical packer, e.g. to prevent setting of the packer prior to reaching a desired borehole location.

According to an embodiment, the mechanical packer may be set via manipulation of a setting mandrel which extends through at least a portion of the mechanical packer. The setting mandrel works in cooperation with a locking assembly which comprises a releasable locking mechanism. By way of example, the releasable locking mechanism may comprise a collet, a releasable ball, a locking dog, or a snap ring. The releasable locking mechanism may be initially locked against the setting mandrel and held in place via a piston, e.g. an annular piston, received in a piston chamber, e.g. an annular chamber surrounding the setting mandrel. By way of example, the annular piston may comprise a radially extended portion received in a corresponding annular chamber disposed around the setting mandrel to provide a space-saving configuration. The piston may be selectively shifted via pressure applied in the piston chamber so as to release the releasable locking mechanism, thus enabling actuation of the mechanical packer via the setting mandrel.

The locking assembly may comprise various other features to further guard against premature setting of the mechanical packer. For example, pressurized hydraulic fluid may be delivered to the piston chamber via a passage containing a pressure release mechanism. The pressure release mechanism may comprise a rupture disc, a temporary plug, a controllable valve, or another suitable pressure release mechanism. Additionally, a shear member, e.g. a shear screw, may initially couple the piston with a surrounding housing to prevent movement of the piston with respect to the housing prior to application of sufficient pressure in the piston chamber.

Figure 1:
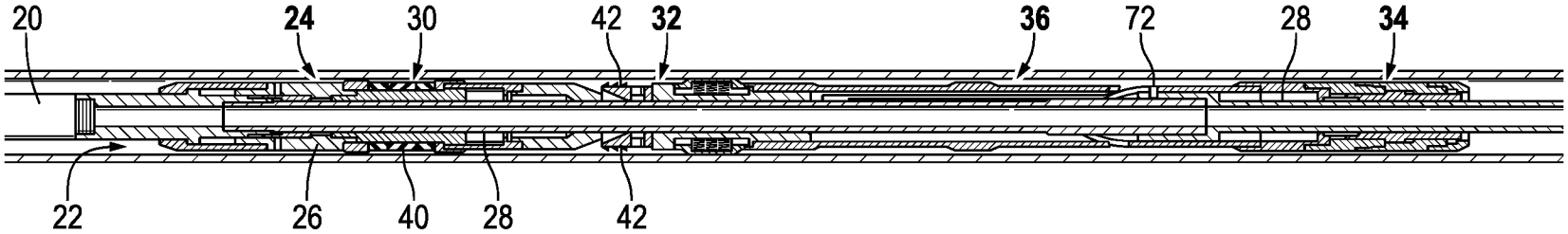
FIG. 1 is a schematic illustration of a well string comprising an example of a mechanical packer being deployed in a borehole, according to an embodiment of the disclosure.

Referring generally to FIG. 1, an embodiment of a well string 20 is illustrated as deployed in a borehole 22, e.g. a wellbore. The well string comprises a mechanical packer 24 having a packer body 26 and an internal setting mandrel 28. In this embodiment, the mechanical packer 24 further comprises a seal section 30, a slip section 32, and a locking assembly 34. In some embodiments, the mechanical packer 24 also may comprise a J-slot mechanism/section 36 which may be used in cooperation with setting mandrel 28 to set both the seal section 30 and the slip section 32 against a surrounding wellbore wall 38, e.g. a surrounding casing.

The packer components may comprise various parts, features, and configurations. For example, the seal section 30 may comprise at least one expandable, elastomeric seal element 40 which is sometimes referred to as a packing element. The slip section 32 may comprise at least one slip region having a plurality of slips 42. When mechanical packer 24 is set against casing 38 or other type of surrounding wall, the setting mandrel 28 is mechanically manipulated to force seal element 40 and slips 42 in a radially outward direction until securely engaged with the surrounding casing 38.

If J-slot mechanism 36 is utilized, the setting mandrel 28 may be moved longitudinally in a sequential longitudinal motion in cooperation with the J-slot mechanism 36 through sequential positions until the seal element 40 and slips 42 are radially expanded into engagement with surrounding casing 38. Similarly, setting mandrel 28 may subsequently be moved longitudinally in cooperation with the J-slot mechanism 36 so as to release the seal element 40 and slips 42 from engagement with the surrounding casing 38. Once released, the mechanical packer 24 and well string 20 may be retrieved to, for example, the surface.

Figure 2:
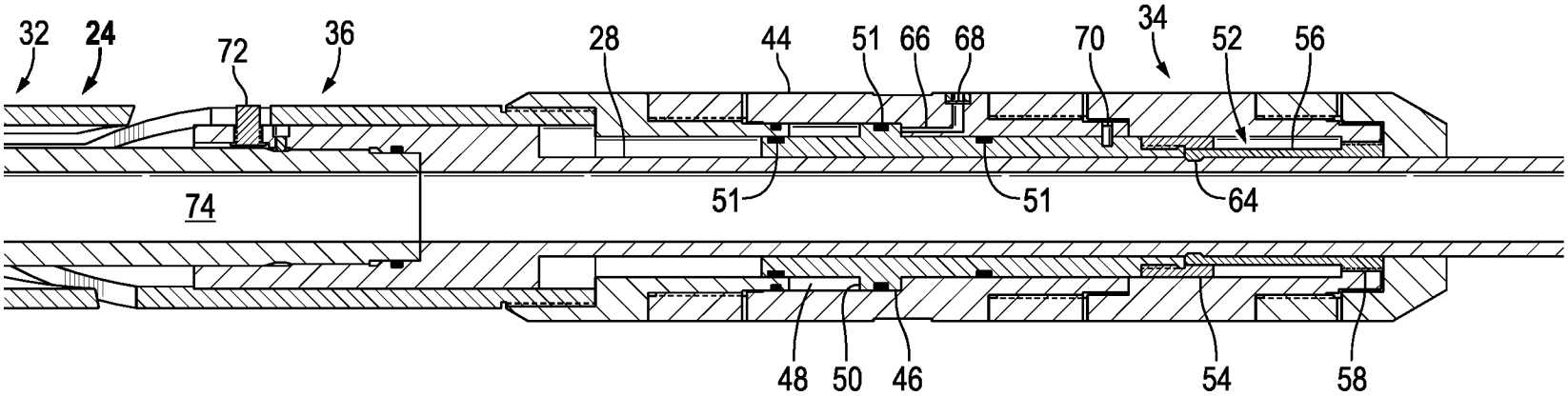
FIG. 2 is a cross-sectional illustration of an example of a locking assembly for use in the mechanical packer, according to an embodiment of the disclosure.

With additional reference to FIG. 2, an embodiment of locking assembly 34 is illustrated. In this example, the locking assembly 34 comprises a housing 44 disposed about the setting mandrel 28 and a piston 46 slidably received between the housing 44 and the setting mandrel 28. The piston 46 is slidably disposed at least partially within a piston chamber 48. Housing 44 may be coupled to or formed as part of packer body 26. According to the embodiment illustrated, the piston 46 may be in the form of an annular piston disposed about the circumference of setting mandrel 28 and having a radially extended portion 50. In this embodiment, the radially extended portion 50 extends into piston chamber 48 which is in the form of an annular piston chamber. The annular piston chamber 48 may be formed in housing 44 along an interior of the housing. Appropriate seals 51, e.g. O-ring seals, may be placed along piston 46, e.g. between piston 46 and housing 44.

As illustrated, the locking assembly 34 further comprises a releasable locking mechanism 52 which may be selectively locked in engagement with the setting mandrel 28 via piston 46. For example, the piston 46 may comprise a locking portion 54 which slides over the releasable locking mechanism 52 so as to securely hold the releasable locking mechanism 52 in locked engagement with setting mandrel 28. When the releasable locking mechanism 52 is locked with setting mandrel 28, movement of the setting mandrel 28 relative to housing 44 is limited, e.g. prevented. The locking portion 54 may be a unitary part of piston 46 or may be a separate component coupled with the remainder of piston 46. In the example illustrated, the locking portion 54 also is an annular portion which may be slid over the releasable locking mechanism 52 between the releasable locking mechanism 52 and surrounding housing 44.

Figure 3:
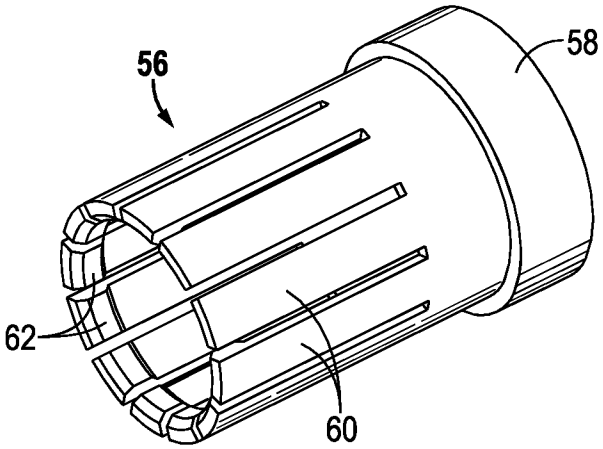
FIG. 3 is an illustration of an example of a releasable locking mechanism which may be employed in the locking assembly, according to an embodiment of the disclosure.

The releasable locking mechanism 52 may be constructed according to the parameters of a given application. As further illustrated in FIG. 3, for example, the releasable locking mechanism 52 may be constructed in the form of a collet 56 having a collet base 58 secured to housing 44. The collet 56 further comprises a plurality of collet fingers 60 arranged circumferentially around setting mandrel 28. At least some of the collet fingers 60 comprise engagement ends 62 constructed for engagement with a corresponding recess 64 formed in an outer surface of setting mandrel 28.

By way of example, the engagement ends 62 may be in the form of radial ridges extending inwardly and shaped for gripping engagement with mandrel recess 64. The collet fingers 60 may be constructed as spring members biased in a direction to release engagement ends 62 from mandrel 28. As illustrated in FIG. 2, piston 46, e.g. locking portion 54, is initially slid over the exterior of collet fingers 60 so as to securely hold engagement ends 62 in locking engagement with recess 64 of mandrel 28. When piston 46 is actuated via applied pressure, the piston 46 is shifted longitudinally until locking portion 54 releases collet fingers 60.

At this release stage, the collet fingers 60 act as spring members and move the corresponding engagement ends 62 radially outward and out of engagement with recess 64 of setting mandrel 28. The mandrel 28 is then freed for longitudinal movement with respect to housing 44 to enable setting of packer 24. For example, the setting mandrel 28 may be used in cooperation with J-slot mechanism 36 and can be manipulated through a predetermined sequence of longitudinal movements to actuate seal section 30 and slip section 32 to a set position.

Hydraulic actuating fluid may be selectively delivered to piston chamber 48 to cause the desired shifting of piston 46 once, for example, the mechanical packer 24 is at a desired location along borehole 22. In the illustrated example, hydraulic actuating fluid is delivered via a passageway 66 located in housing 44. In some applications, the passageway 66 may extend between piston chamber 48 and an exterior region surrounding packer 24, e.g. the annulus between packer 24 and casing 38. In this example, the natural pressure of the wellbore or additional pressure applied down through the annulus between packer 24 and casing 38 may be used to shift piston 46 along piston chamber 48 until the releasable locking mechanism 52 is released. In some applications, a separate control line may be used to deliver the hydraulic actuating fluid under pressure.

To prevent premature shifting of piston 46, a pressure release mechanism 68 may be positioned along passageway 66. By way of example, the pressure release mechanism 68 may be in the form of a rupture disc disposed across the passageway 66. Once sufficient pressure is applied in passageway 66, the rupture disc 68 simply ruptures and allows the pressurized actuating fluid to flow into piston chamber 48. In some embodiments, the piston 46 also may be initially constrained with respect to housing 44 via a shear member 70, such as a shear screw or screws. If the mechanical packer 24 comprises J-slot mechanism 36, a J-pin 72 also may serve to help initially constrain the setting mandrel 28 during, for example, running in hole.

The sequence of operation for releasing setting mandrel 28 and for setting packer 24 at a desired location in borehole 22 may vary. By way of example, the packer 24 may be set and unset via surface manipulation of well string 20 to move setting mandrel 28 back and forth in a longitudinal direction, e.g. up and down. The setting mandrel 28 may initially be locked by the collet 56 and the J-pin 72 during running in hole. While running in hole, the collet fingers 60 of collet 56 are constrained by locking portion 54 of piston 46 such that engagement ends 62 are locked with recess 64. The piston 46 may be constrained with respect to housing 44 via shear member 70.

The rupture disc 68 is placed along passageway 66 and may be selected with an appropriate threshold rupture pressure based on the desired well depth to which packer 24 is deployed. After reaching the desired well depth and/or desired wellbore hydrostatic pressure, the rupture disc 68 is ruptured so that fluid may flow from the surrounding annulus and into piston chamber 48 on the appropriate side of radially extended portion 50. As the fluid flows through passageway 66, the shear member 70 is sheared and the piston 46 is slidably shifted.

Once the piston 46 is shifted a sufficient distance along piston chamber 48, the locking portion 54 of piston 46 uncovers the tips of the collet fingers 60 to release the collet fingers. The collet fingers spring radially outwardly so that engagement ends 62 are withdrawn from recess 64. Consequently, the setting mandrel 28 is freed, and the packer 24 can be set via a longitudinal movement or sequence of longitudinal movements applied to setting mandrel 28 via well string 20. In various applications, setting mandrel 28 has a hollow internal passage 74 to enable flow of fluids along an interior of well string 20.

Figure 4:
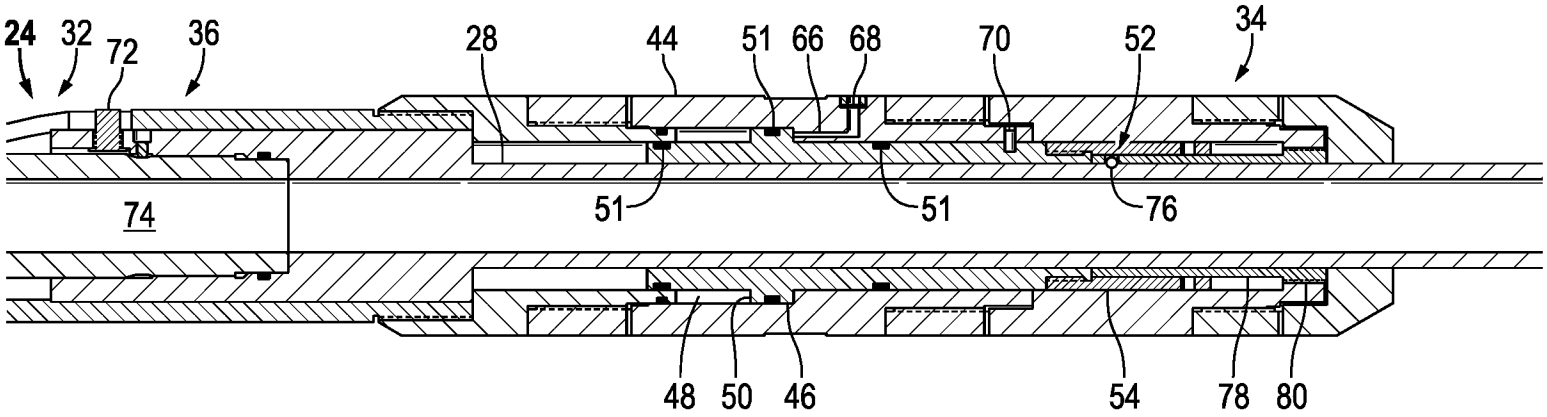
FIG. 4 is a cross-sectional illustration of another example of a locking assembly for use in the mechanical packer, according to an embodiment of the disclosure.
Figure 5:
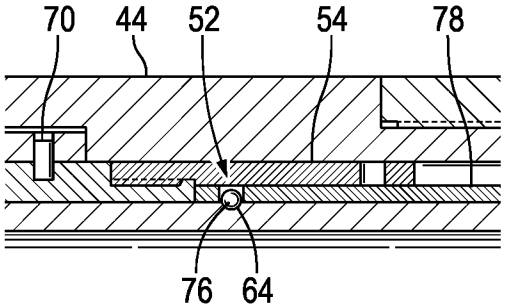
FIG. 5 is an illustration of another example of a releasable locking mechanism which may be employed in the locking assembly, according to an embodiment of the disclosure.

Referring generally to FIGS. 4 and 5, another embodiment of locking assembly 34 is illustrated. In this example, many of the components are the same or similar as those described above with reference to FIG. 2 and have been labeled with the same reference numerals. However, releasable locking mechanism 52 of locking assembly 34 comprises a ball 76, e.g. a ball pin, releasably received in recess 64 of setting mandrel 28. In some embodiments, the ball or balls 76 may be carried via a ball carrier 78 secured to housing 44 via a ball carrier base 80. The ball(s) 76 is held in recess 64 by piston 46, thus locking setting mandrel 28 with respect to housing 44 and packer body 26. It should be noted ball 76 may have an elongated shape, elliptical shape, or other curvilinear, non-spherical shape In this embodiment, the selective release of locking mechanism 52 and subsequent setting of packer 24 may be achieved via a sequence similar to that described above with reference to FIGS. 2 and 3. For example, after reaching the desired well depth and/or desired wellbore hydrostatic pressure, the pressure release mechanism 68 is released, e.g. ruptured, so that fluid may flow from the surrounding annulus and into piston chamber 48 on the appropriate side of radially extended portion 50. As the fluid flows through passageway 66, the shear member 70 is sheared and the piston 46 is slidably shifted.

Once the piston 46 is shifted a sufficient distance, the locking portion 54 of piston 46 uncovers the ball or balls 76 so that the ball(s) 76 may move radially outwardly to release setting mandrel 28. Because of their shape, the balls 76 may be readily moved to the radially outward position via movement of setting mandrel 28. For example, the recess 64 may be appropriately shaped so as to force each ball 76 outwardly as the setting mandrel 28 is moved longitudinally. Each ball 76 may readily be moved in the radially outward direction at this stage because the ball(s) 76 is no longer constrained via piston 46. Consequently, the setting mandrel 28 is freed, and the packer 24 can be set via a longitudinal movement or sequence of longitudinal movements applied to setting mandrel 28 via well string 20.

Figure 6:
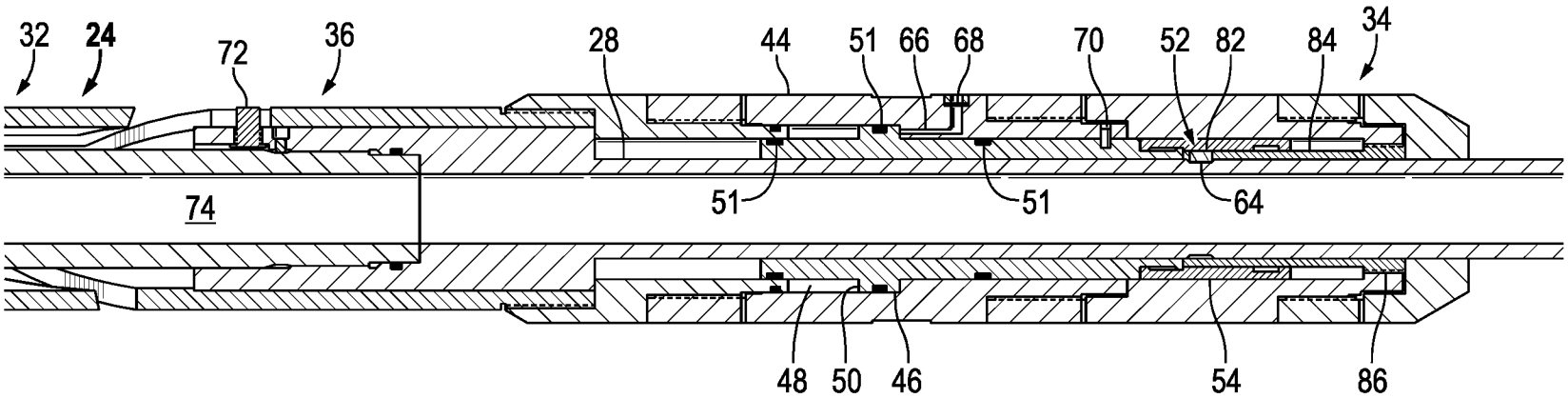
FIG. 6 is a cross-sectional illustration of another example of a locking assembly for use in the mechanical packer, according to an embodiment of the disclosure.
Figure 7:
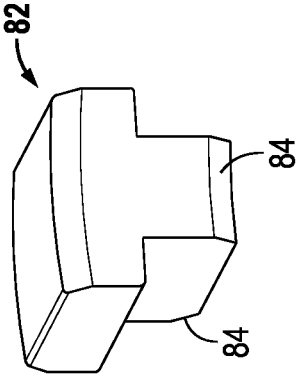
FIG. 7 is an illustration of another example of a releasable locking mechanism which may be employed in the locking assembly, according to an embodiment of the disclosure.

Referring generally to FIGS. 6 and 7, another embodiment of locking assembly 34 is illustrated. In this example, many of the components are the same or similar as those described above and have been labeled with the same reference numerals. The embodiment illustrated in FIGS. 6 and 7 is similar to the embodiment described with reference to FIGS. 4 and 5. However, releasable locking mechanism 52 of locking assembly 34 comprises a locking dog 82 (instead of ball 76) releasably received in recess 64 of setting mandrel 28. In some embodiments, the locking dog or dogs 82 may be carried via a locking dog carrier 84 secured to housing 44 via a carrier base 86. The locking dog 82 is held in recess 64 by piston 46, thus locking setting mandrel 28 with respect to housing 44 and packer body 26.

In this embodiment, the selective release of locking mechanism 52 and subsequent setting of packer 24 may again be achieved via a sequence similar to that described above with reference to FIGS. 2 and 3. For example, after reaching the desired well depth and/or desired wellbore hydrostatic pressure, the pressure release mechanism 68 is released, e.g. ruptured, so that fluid may flow from the surrounding annulus and into piston chamber 48 on the appropriate side of radially extended portion 50. As the fluid flows through passageway 66, the shear member 70 is sheared and the piston 46 is slidably shifted along piston chamber 48.

Once the piston 46 is shifted a sufficient distance, the locking portion 54 of piston 46 uncovers the locking dog or dogs 82 so that the dog(s) 82 may move radially outwardly to release setting mandrel 28. The locking dogs 82 may comprise beveled edges 84 or other features shaped and oriented to engage corresponding walls of recess 64. The beveled edges/features 84 as well as the shape of recess 64 may be selected so as to force each locking dog 82 outwardly as the setting mandrel 28 is moved longitudinally while the locking dog 82 is no longer constrained via piston 46. Consequently, the setting mandrel 28 is freed, and the packer 24 may be set via a longitudinal movement or sequence of longitudinal movements applied to setting mandrel 28 via well string 20.

Figure 8:
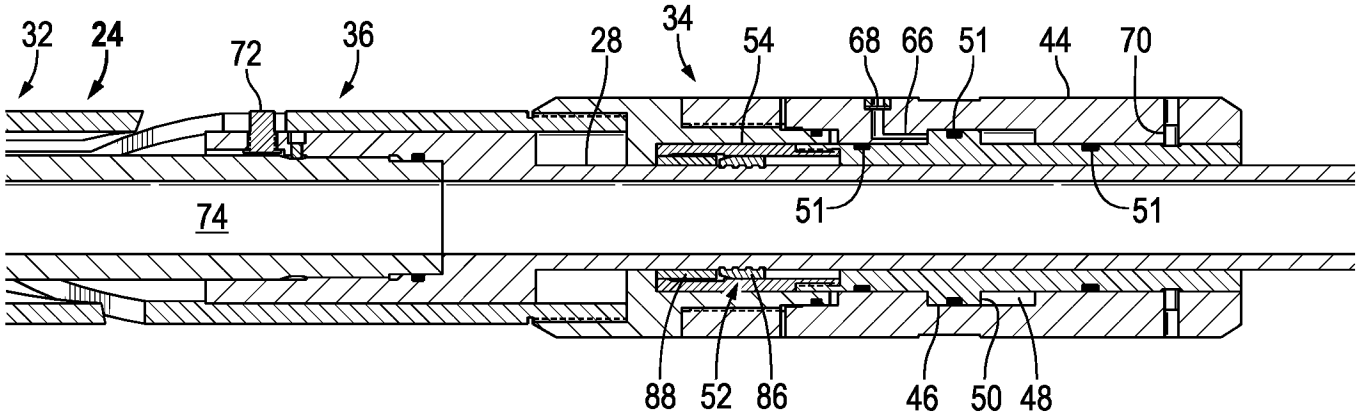
FIG. 8 is a cross-sectional illustration of another example of a locking assembly for use in the mechanical packer, according to an embodiment of the disclosure.
Figure 9:
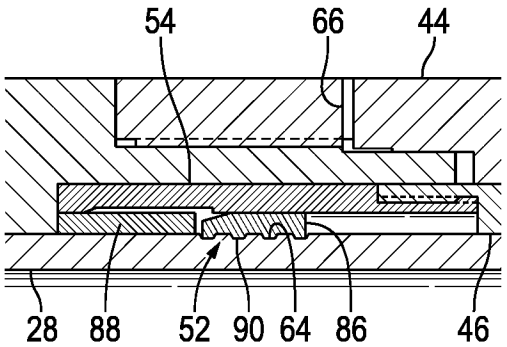
FIG. 9 is an illustration of another example of a releasable locking mechanism which may be employed in the locking assembly, according to an embodiment of the disclosure.

Referring generally to FIGS. 8 and 9, another embodiment of locking assembly 34 is illustrated. In this example, many of the components are the same or similar as those described above and have been labeled with the same reference numerals. However, releasable locking mechanism 52 of locking assembly 34 comprises a snap ring 86, e.g. a C-ring, which may be constructed to provide a natural spring bias in a radially outward direction. The snap ring 86 is releasably received in recess 64 of setting mandrel 28 and initially constrained by piston 46, e.g. by piston locking portion 54. In some embodiments, the snap ring 86 may be held in position with respect to housing 44 via a carrier or abutment 88 (see FIG. 9). Engagement features 90 of the snap ring 86 are held in recess 64 by piston 46, thus locking setting mandrel 28 with respect to housing 44 and packer body 26.

In this embodiment, the selective release of locking mechanism 52 and subsequent setting of packer 24 may again be achieved via a sequence similar to that described above with reference to FIGS. 2 and 3. For example, after reaching the desired well depth and/or desired wellbore hydrostatic pressure, the pressure release mechanism 68 is released, e.g. ruptured, so that fluid may flow from the surrounding annulus and into piston chamber 48 on the appropriate side of radially extended portion 50. As the fluid flows through passageway 66, the shear member 70 is sheared and the piston 46 is slidably shifted along piston chamber 48.

Once the piston 46 is shifted a sufficient distance, the locking portion 54 of piston 46 uncovers the snap ring 86 and the natural spring characteristics of the snap ring 86 cause of the snap ring 86 to expand radially outwardly, thus releasing setting mandrel 28. The engagement features 90 are simply pulled away from the corresponding recess 64 via the spring nature of snap ring 86. Consequently, the setting mandrel 28 is freed, and the packer 24 may be set via a longitudinal movement or sequence of longitudinal movements applied to setting mandrel 28 via well string 20.

Accordingly, well string 20 may be constructed in a variety of arrangements to facilitate the specific parameters of a given downhole operation. The well string 20 may comprise an individual mechanical packer 24 or a plurality of the mechanical packers 24. Similarly, the mechanical packer 24 may comprise various components and features. In some embodiments, for example, the mechanical packer 24 may comprise the J-slot mechanism 36 and the J-slot mechanism 36 may be constructed with various configurations to enable actuation of packer 24 via desire longitudinal movements of well string 20 and setting mandrel 28. The type and number of seal sections 30 and slip sections 32 also may be selected according to the parameters of a given application.

The locking assembly 34 also may comprise various components arranged in different configurations to achieve a desired temporary locking capability. The locking assembly 34 may utilize various types of pistons 46 and corresponding piston chambers 48. Similarly, the releasable locking mechanism 52 may have various constructions for cooperation with the piston 46. In some applications, the releasable locking mechanism 52 comprises a spring member, e.g. collet fingers 60 or snap-ring 86. The setting mandrel 28 also may have various types of recesses or other features which work in cooperation with the releasable locking mechanism 52 to temporarily lock the setting mandrel 28 so as to prevent premature setting of packer 24. Various types of pressure release mechanisms also may be employed to initially block the flow of actuating fluid to the piston. The pressure release mechanisms may comprise various types of rupture discs, removable plugs, valves, or other suitable pressure release mechanisms.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a mechanical packer having a seal section, a slip section, a J-slot section, and a locking assembly, the seal section and the slip section being actuatable to a set position via shifting of an internal setting mandrel in cooperation with the J-slot section, the locking assembly interacting with the internal setting mandrel to prevent premature setting of the mechanical packer, the locking assembly comprising:

a housing disposed about the internal setting mandrel;

an annular piston having a locking portion, the annular piston slidably received between the housing and the internal setting mandrel in an annular piston chamber formed in the housing, a portion of the annular piston extending radially into the annular piston chamber;

a releasable locking mechanism configured to lock the internal setting mandrel in place when the locking portion of the annular piston is positioned over the releasable locking mechanism to limit movement of the internal setting mandrel relative to the housing; and a pressure release mechanism positioned along a passageway between an exterior of the housing and the annular piston chamber, the pressure release mechanism opening the passageway to fluid flow upon sufficient application of pressure, the fluid pressure shifting the annular piston to release the releasable locking mechanism from the internal setting mandrel.

2. The system as recited in claim 1, wherein the releasable locking mechanism comprises a collet releasably held by the annular piston in a locked position in which the collet is engaged with a corresponding feature of the internal setting mandrel.

3. The system as recited in claim 1, wherein the releasable locking mechanism comprises a ball releasably held by the annular piston in a locked position in which the ball is engaged with a corresponding feature of the internal setting mandrel.

4. The system as recited in claim 1, wherein the releasable locking mechanism comprises a locking dog releasably held by the annular piston in a locked position in which the locking dog is engaged with a corresponding feature of the internal setting mandrel.

5. The system as recited in claim 1, wherein the releasable locking mechanism comprises a snap ring releasably held by the annular piston in a locked position in which the snap ring is engaged with a corresponding feature of the internal setting mandrel.

6. The system as recited in claim 1, wherein the releasable locking mechanism comprises a spring member releasably held by the annular piston in a locked position in which the spring member is engaged with a corresponding feature of the internal setting mandrel.

7. The system as recited in claim 1, wherein the releasable locking mechanism is held in a corresponding recess in the internal setting mandrel when in a locked position.

8. The system as recited in claim 1, wherein the pressure release mechanism comprises a rupture disc.

9. The system as recited in claim 1, wherein the annular piston is initially secured to the housing via a shear member.

10. A system, comprising:

a mechanical packer actuatable to a set position via an internal setting mandrel, the mechanical packer initially being maintained in an unset position by a releasable locking mechanism held in locking engagement with the internal setting mandrel when a locking portion of an annular piston is positioned over the releasable locking mechanism, the annular piston disposed circumferentially around the internal setting mandrel, the annular piston being selectively shiftable within an annular piston chamber to release the releasable locking mechanism and thus the internal setting mandrel upon application of sufficient pressurized fluid into the piston chamber.

11. The system as recited in claim 10, wherein the mechanical packer comprises at least one seal section.

12. The system as recited in claim 10, wherein the mechanical packer comprises at least one slip section and at least one J-slot section.

13. The system as recited in claim 10, wherein the mechanical packer comprises a passage between the piston chamber and an exterior of the mechanical packer, the passage being initially blocked by a pressure release mechanism.

14. The system as recited in claim 13, wherein the pressure release mechanism comprises a rupture disc.

15. The system as recited in claim 10, wherein the releasable locking mechanism comprises a collet engaged with a recess in the internal setting mandrel.

16. The system as recited in claim 10, wherein the releasable locking mechanism comprises a ball engaged with a recess in the internal setting mandrel.

17. The system as recited in claim 10, wherein the releasable locking mechanism comprises a locking dog engaged with a recess in the internal setting mandrel.

18. A method, comprising:

releasably locking a setting mandrel of a mechanical packer with a releasable locking mechanism temporarily held in place via an annular piston having a locking portion, the annular piston located in an annular piston chamber surrounding the setting mandrel;

conveying the mechanical packer into a borehole;

shifting the annular piston, via pressure applied in the annular piston chamber, to release the releasable locking mechanism and to thus release the setting mandrel; and mechanically manipulating the setting mandrel to set the mechanical packer at a desired location in the borehole.

19. The method as recited in claim 18, wherein shifting comprises rupturing a pressure release mechanism.

20. The method as recited in claim 18, wherein shifting comprises releasing the releasable locking mechanism from a recess in the setting mandrel.

* * * * *